US005322039A

United States Patent [19]

Kinsey

[11] Patent Number: 5,322,039

[45] Date of Patent: Jun. 21, 1994

[54] VALVE SPRING TOP COLLAR

[75] Inventor: Dan L. Kinsey, LaFarge, Wis.

[73] Assignee: S & S Cycle, Inc., Viola, Wis.

[21] Appl. No.: 128,482

[22] Filed: Sep. 28, 1993

[51] Int. Cl.[5] ..... F01L 3/10

[52] U.S. Cl. ..... 123/90.67; 123/90.65; 123/188.17; 123/188.13; 251/337

[58] Field of Search ..... 123/90.65, 90.66, 90.67, 123/188.13, 188.17; 251/337

[56] References Cited

U.S. PATENT DOCUMENTS

| | | | |
|---|---|---|---|
| 2,314,059 | 3/1943 | Steiner | 251/337 |
| 3,428,296 | 2/1969 | Erickson | 251/337 |
| 3,612,016 | 10/1971 | Jelen | 123/90.67 |
| 4,509,473 | 4/1985 | Hamparian | 251/337 |
| 4,515,346 | 5/1985 | Gaterman, III | 251/337 |
| 4,653,726 | 3/1987 | Lang et al. | 251/337 |
| 4,989,556 | 2/1991 | Shiina et al. | 123/90.67 |
| 5,143,351 | 9/1992 | Pierce | 251/337 |
| 5,255,640 | 10/1993 | Pierce | 251/337 |

*Primary Examiner*—E. Rollins Cross
*Assistant Examiner*—Weilun Lo
*Attorney, Agent, or Firm*—Foley & Lardner

[57] ABSTRACT

A valve spring top collar is formed by a unitary body having a circular top face and a bottom surface, with a first circular shoulder extending downwardly from the bottom surface of the body and a second inwardly spaced circular shoulder. The shoulders are inserted into the valve springs so that the springs cannot slip off the collar in a radial direction. A central aperture extends through the central core of the body, through which a valve stem is inserted. A plurality of peripheral apertures extend through the body about the central aperture, thereby decreasing the total weight of the collar and allowing flow of lubricant to the springs.

16 Claims, 2 Drawing Sheets

VALVE SPRING TOP COLLAR

FIELD OF THE INVENTION

This invention pertains generally to the field of components for internal combustion engines, and particularly to valve spring top collars for intake and exhaust valve springs on internal combustion engines.

BACKGROUND OF THE INVENTION

In internal combustion engines, the intake and exhaust valves are actuated by a cam or rocker pushing against the end of the valve stem, which then slides through the valve guide. The valve head at the end of the valve stem then clears its seat and opens the passage between the intake or exhaust passageway and the combustion chamber, allowing gases to enter or exit the chamber. The valve is forced to follow the motion of the cam or rocker by a valve spring, which may actually consist of several springs of varying diameter, with the inner spring(s) lying within the coils of another spring. The valve spring sits in a state of compression between the valve spring seat, which is mounted on the cylinder head and is therefore stationary, and the valve spring top collar, which is affixed to the end of the moving valve stem. The spring force is thereby transmitted to the valve stem, which is thus forced against the cam or rocker as the cam or rocker rises, causing the valve to close. A common conventional valve spring top collar resembles a solid disk with a central opening to admit the valve stem and a raised shoulder (or shoulders) on its underside to which the valve spring (or springs) is engaged.

A longstanding goal of engine design is to produce greater engine power while simultaneously achieving better fuel economy. Engine components of lighter weight further this goal because lower engine component weight decreases the amount of work necessary for operation, thereby increasing engine efficiency.

SUMMARY OF THE INVENTION

A valve spring top collar in accordance with the present invention is constructed to have lighter weight than conventional top collars, thereby increasing the efficiency of the engine, while simultaneously providing better engine lubricant access to the valve spring assembly and improved cooling of the assembly. The top collar of the invention incorporates several peripheral apertures into its structure to minimize its weight while maintaining sufficient structural strength and rigidity. These apertures also promote lubricant access to the valve springs, valve, and valve guide by allowing lubricant to flow from the cam or rocker area through the apertures onto the valve spring assembly, as well as allowing flow of cooling air. Effective lubrication of the valve spring assembly, including the inner springs, reduces friction and decreases the work needed to move the valves, thereby increasing engine efficiency, and also aids in cooling the valve spring assembly and preventing premature failure.

A valve spring top collar in accordance with the invention includes a unitary body with a top face having a circular peripheral edge and a bottom surface, a central aperture extending through a central core of the body from the top face to the bottom surface of the body, through which the valve stem extends, a circular shoulder extending downwardly from the bottom surface and spaced inwardly from the peripheral edge, to engage the valve spring and prevent the end of the valve spring from slipping across the bottom of the collar in a radial direction. A second circular shoulder may be formed in the bottom surface, spaced inwardly from the first shoulder, to engage and restrain the end of an inner valve spring (if present) from slipping. The top collar further includes a plurality of peripheral apertures, extending through the body from the top face to the bottom surface at positions between the central aperture and the outer peripheral edge, which help decrease the weight of the top collar and also provide channels by which engine lubricant and cooling air may access the valve spring assembly. Struts are defined between the apertures which are generally radially oriented. These struts connect a circular rim portion of the top collar with the central core, and provide adequate structural rigidity with minimum weight.

Further objects, features and advantages of the invention will be apparent from the following detailed description when taken in conjunction with the accompanying drawings.

DETAILED DESCRIPTION OF THE INVENTION

Figure 1:
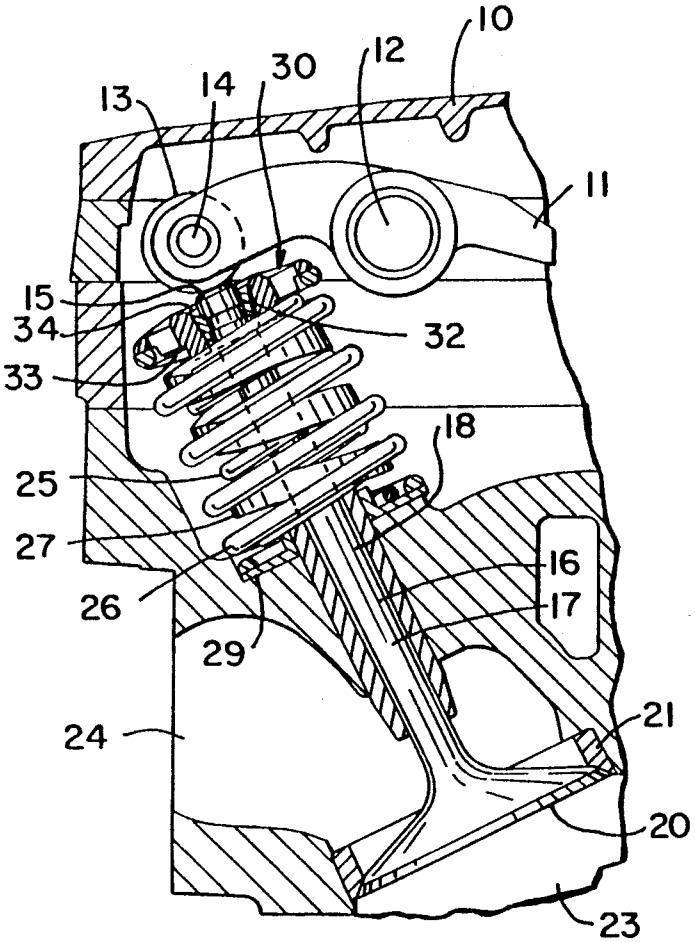
FIG. 1 is a partial cross-sectional view of a head of a typical internal combustion engine, showing the valve assembly with valve springs and the top collar of the invention.

With reference to the drawings, a portion of the cylinder head 10 of an internal, combustion engine is shown in cross-section in FIG. 1. For purpose of illustrating the invention, the head 10 includes a rocker arm 11 which is activated by a pushrod or cam (not shown) and pivots about a rocker arm pin 12. The rocker arm force is transferred through the rocker arm 11 to a rocker arm roller 13, which pivots about a roller pin 14. The rocker arm roller 13 in turn transmits the force to the top surface 15 of a valve stem 16 of a valve 17. The valve 17 may be either an intake or an exhaust valve. When pushed, the valve stem 16 slides in a valve guide 18, thereby allowing the valve head 20 to lift from the valve head seat 21 and accept intake gases into, or release exhaust gases from, a combustion chamber 23 via an intake or exhaust passageway 24.

High-performance engines generally use more than one valve spring, and for illustration a trio of valve springs are shown, an inner spring 25, an outer spring 26, and a middle spring 27. The middle spring 27 may be used for harmonic dampening purposes and, for exemplification, is formed of a square-wire spring which is interference-fit within the coils of the inner and outer springs 25 and 26. The valve springs are held in compression between a valve spring seat 29 and a valve spring top collar 30 in accordance with the invention, with the valve stem 16 extending through the coils of the springs 25, 26, and 27 at their coincident central axes. The top end of the valve stem 16 is effectively attached to the valve spring top collar 30 by collar wedges 32 which engage a groove 33 in the top end of the valve stem 16. To attach the valve stem 16 to the valve spring top collar 30, the valve springs are compressed, the valve stem 16 is inserted through a central aperture 34 in the valve spring top collar 30, and the collar wedges 32 are inserted into the groove 33 on the valve stem 16, to hold the valve spring top collar 30 in place once the valve springs are unloaded.

Figures 2, 3, 7:
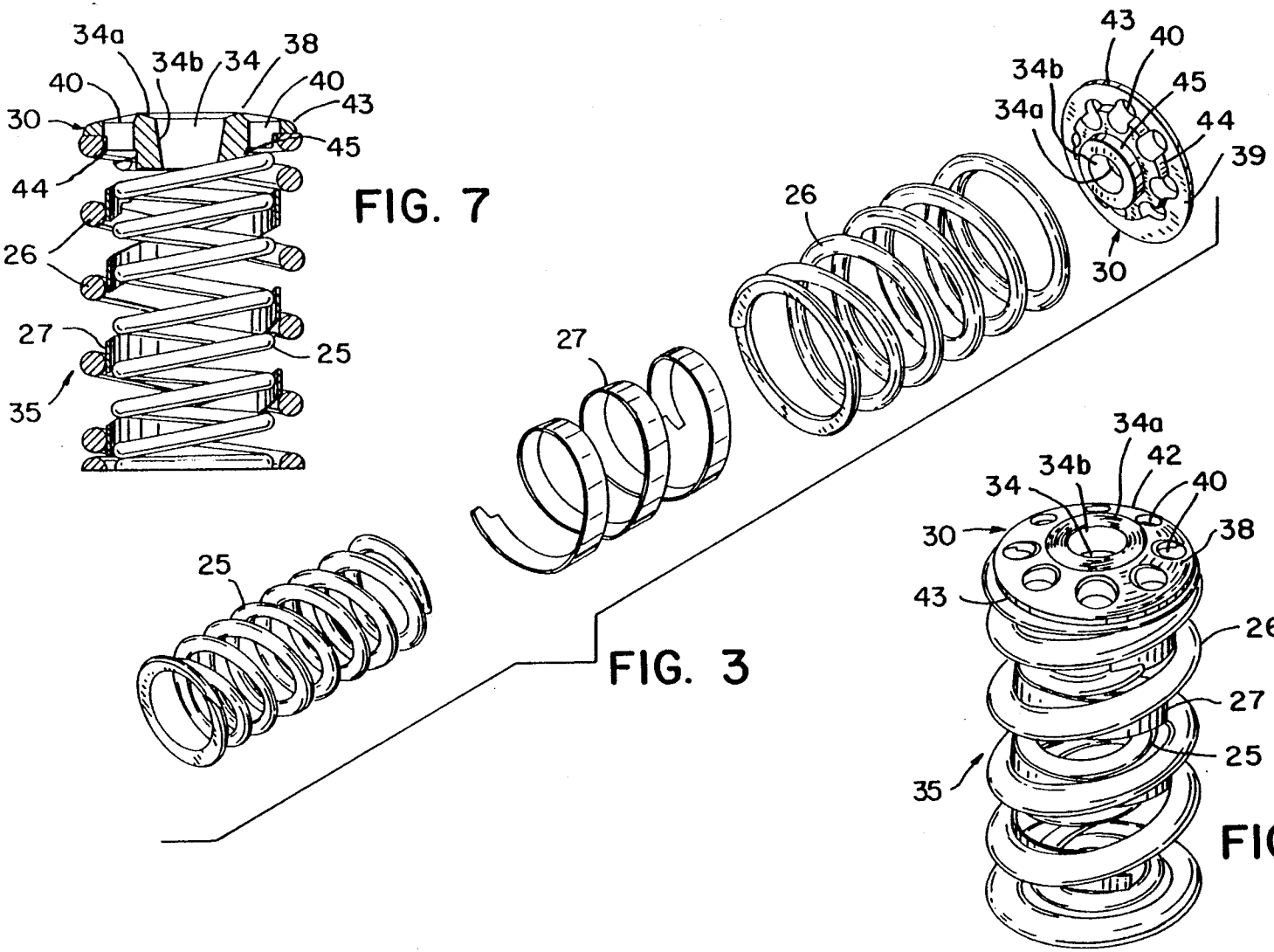
FIG. 2 is a perspective view of the valve spring assembly including the valve springs and top collar.
FIG. 3 is an exploded perspective view of the valve springs and top collar, illustrating an inner, outer, and a middle spring, and the shoulders on the collar on which the ends of the inner and outer springs rest.
FIG. 7 is a cross-sectional view of the valve spring assembly including the top collar and the outer, middle and inner valve springs, with the top collar resting atop the valve springs and the inner valve spring shown intact.

A complete valve spring assembly 35 in accordance with the invention is shown in FIG. 2 in perspective and in FIG. 7 in cross-section. The central aperture 34 through which the valve stem extends is formed in the central core 37 of the top cover 30 and extends from a top face 38 of the cover to the bottom surface 39 of the cover. A plurality of spaced peripheral apertures 40 are formed in the top collar around the central core 37. Struts 41 are defined between the peripheral apertures 40 and connect the central core 37 to a solid peripheral rim 42 having a circular peripheral edge 43.

Figure 4:
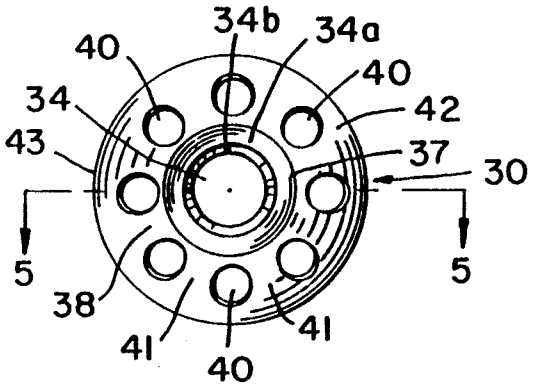
FIG. 4 is a top view of the top collar.
Figure 5:
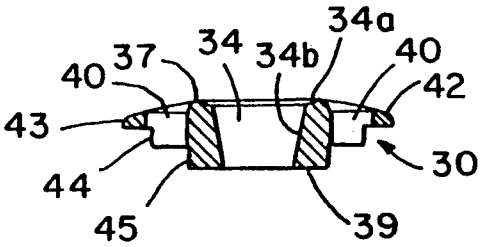
FIG. 5 is a cross-sectional view of the top collar taken along the lines 5—5 of FIG. 4.
Figure 6:
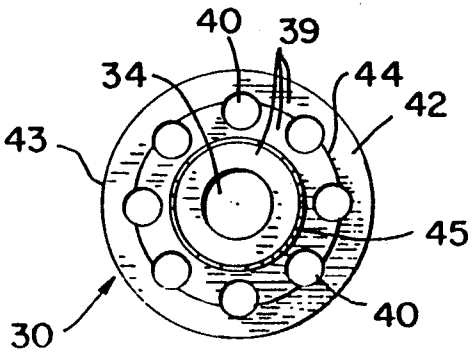
FIG. 6 is a bottom view of the collar.

As best shown in FIGS. 5 and 7, the central aperture 34 is in the shape of two intersecting frustoconical walls **34*a* and 34*b* which share the same axis. The collar wedges 32 engage the surface 34*b* and the valve stem groove 33 as the valve springs push the bottom of the valve spring top collar 30 away from the valve spring seat 29, to effectively attach the collar 30 to the valve stem 16. The surface 34*a* is shaped frustoconically so that the rocker arm roller 13 will only contact the end 15 of the valve stem and not the valve spring top collar 30. The frustoconical shape of the surface 34*a* also forms the outer walls of an annular depression in the top face of valve spring collar 30. This depression can collect lubricant dripping off the rocker arm roller 13, and upon overflowing the depression, the lubricant runs down the top face 38 of the valve spring top collar 30 and through the apertures 40**.

The bottom surface 39 of the valve spring top collar has a first circular shoulder 44 and second circular shoulder 45. The outer valve spring 26 rests with its end engaged around and against the outer shoulder 44, and with its inner diameter closely matching the diameter of the shoulder to restrain the spring. The inner valve spring 25 rests with its end engaged around and against the inner shoulder 45 with its inner diameter closely matching the diameter of the inner shoulder to hold the inner spring in place. The middle harmonic dampener spring 27 is held in place between the inner and outer springs.

The peripheral apertures 40 are preferably evenly spaced about the valve spring top collar core 37, with the diameter of the apertures preferably selected such that they extend substantially between the outer shoulder 44 and the inner shoulder 45; consequently, lubricant may flow through the apertures 40 and onto the tops of the valve springs 25, 26, and 27, and may then flow down between the springs, cooling as well as lubricating them. Furthermore, the peripheral apertures allow air to flow through them to further cool the valve and the valve spring assembly. The enhanced lubrication thereby provided reduces wear and heat, two factors which contribute to premature spring fatigue. The enhanced flow of oil and air also carries heat away from the valve assembly, cooling the parts and promoting longer part life and better performance.

The valve spring top collar 30 is preferably formed as a one piece unitary body, and may be made by stamping, forging, casting, etc. from durable material commonly used in engines, e.g., SAE 1144 steel. The peripheral apertures 40 allow the top collar of the invention to be formed to replace conventional top collars of similar materials and dimensions with a significant reduction of weight. For example, an exemplary conventional top collar for valve assemblies used in motorcyle engines having a peripheral edge diameter of 1.44 inches formed of SAE 1144 steel has a mass of 33.5 grams, while an exemplary top collar in accordance with the present invention of the same diameter and material, which has eight peripheral apertures 40, each with a diameter of 0.22 inch, has a mass of 25.9 grams (a 22.7% reduction in weight). The resulting lower mass of the rapidly moving valve assembly results in less power loss in the engine and a faster responding valve and spring assembly.

It is understood that the invention is not confined to the particular construction and arrangement of parts herein illustrated and described, but embraces such modified forms thereof as come within the scope of the following claims.

What is claimed is:

1. A valve spring top collar comprising:

a unitary body having a top face, a bottom surface, and a circular outer peripheral edge, the body including a central core, a central aperture extending through the central core of the body from the top face to the bottom surface of the body, the bottom surface including a first downwardly extending circular shoulder spaced inwardly from the peripheral edge, and a plurality of spaced peripheral apertures extending through the body from the top face to the bottom surface at positions between the central aperture and the outer peripheral edge to define struts between the peripheral apertures which extend radially from the central core to a rim portion of the body.

2. The valve spring top collar of claim 1 wherein the peripheral apertures are each circular and are evenly arranged about the central aperture.

3. The valve spring top collar of claim 2 wherein the peripheral apertures are wider than the material of the body defining the struts between adjacent peripheral apertures.

4. The valve spring top collar of claim 1 wherein the body is formed of steel.

5. The valve spring top collar of claim 1 including a second downwardly extending circular shoulder in the bottom surface of the body, the second shoulder spaced inwardly from the first shoulder.

6. The valve spring top collar of claim 5 wherein the peripheral apertures extend substantially between the first and second shoulders.

7. A valve spring and top collar assembly comprising:

(a) a unitary top collar body having a top face, a bottom surface, and a circular outer peripheral edge, the body including a central core, a central aperture extending through the central core of the body from the top face to the bottom surface of the body, the bottom surface including a first downwardly extending circular shoulder spaced inwardly from the peripheral edge, and a plurality of spaced peripheral apertures extending through the body from the top face to the bottom surface at positions between the central aperture and the outer peripheral edge to define struts between the peripheral apertures which extend radially from the central core to a rim portion of the body; and (b) at least one valve spring engaged at one of its ends to the downwardly extending circular shoulder formed in the top collar body, with the diameter of the shoulder such that the inner diameter of the spring fits tightly about the diameter of the shoulder.

8. The assembly of claim 7 including a second circular shoulder which extends downwardly from the bottom surface of the body and spaced inwardly from the first shoulder, and a second valve spring engaged to the second shoulder, the second shoulder having a diameter such that an inner diameter of the second spring fits tightly about the diameter of the second shoulder.

9. The assembly of claim 8 including a third spring engaged between the first and second springs.

10. The assembly of claim 8 wherein the peripheral apertures extend substantially between the first and second shoulders.

11. A valve spring top collar comprising:

a unitary body having a top face, a bottom surface, and a circular outer peripheral edge, the body including a central core, a central aperture extending through the central core of the body from the top face to the bottom surface of the body, the bottom surface including at least first and second downwardly extending concentric circular shoulders and a plurality of spaced peripheral apertures extending through the body from the top face to the bottom surface at positions between the central aperture and the outer peripheral edge to define struts between the peripheral apertures which extend radially from the central core to a rim portion of the body.

12. The valve spring top collar of claim 11 wherein the peripheral apertures are each circular and are evenly arranged about the central aperture.

13. The valve spring top collar of claim 12 wherein the peripheral apertures are wider than the material of the body defining the struts between adjacent peripheral apertures.

14. The valve spring top collar of claim 12 wherein there are eight peripheral apertures.

15. The valve spring top collar of claim 11 wherein the body is formed of steel.

16. The valve spring top collar of claim 11 wherein the peripheral apertures extend substantially between the first and second shoulders.

* * * * *